US005204509A

United States Patent [19]

Etters et al.

[11] Patent Number: 5,204,509

[45] Date of Patent: Apr. 20, 1993

[54] SELF REGULATING HEATED SWITCH ASSEMBLY

[75] Inventors: Harry N. Etters, Downers Grove; Michael Kaczmarek, Park Ridge, both of Ill.

[73] Assignee: Illinois Tool Works Inc., Glenview, Ill.

[21] Appl. No.: 708,235

[22] Filed: May 31, 1991

[51] Int. Cl.[5] ..... H05B 1/00

[52] U.S. Cl. ..... 219/201; 219/535; 219/209; 219/505

[58] Field of Search ..... 219/201, 535, 504, 505, 219/202, 209, 511

[56] References Cited

U.S. PATENT DOCUMENTS

| | | | |
|---|---|---|---|
| 2,632,083 | 3/1953 | Shaffer | 219/209 |
| 3,564,199 | 2/1971 | Blaha | 219/205 |
| 4,591,692 | 5/1986 | Wightman | 219/209 |
| 4,882,466 | 11/1989 | Friel | 219/219 |

FOREIGN PATENT DOCUMENTS

| | | | |
|---|---|---|---|
| 0002660 | 7/1979 | European Pat. Off. | 219/209 |

*Primary Examiner*—Bruce A. Reynolds
*Assistant Examiner*—Michael D. Switzer
*Attorney, Agent, or Firm*—Schwartz & Weinrieb

[57] ABSTRACT

A self regulating heated switch assembly is provided for heating the interior of a switch housing so as to prevent freezing of switch contacts therein. The switch assembly includes a switch housing, an insulative cover member, and a PTC heater device. The switch housing includes top, bottom, front, rear and end walls. The insulative cover member is formed of opposed front and rear panels. The front and rear panels are disposed in a spaced apart relationship to the corresponding front and rear walls of the switch housing. The heater device is sandwiched between the front wall of the switch housing and the front panel of the cover member and between the rear wall of the switch housing and the rear panel of the cover member so as to transmit heat into the interior of the switch housing.

16 Claims, 2 Drawing Sheets

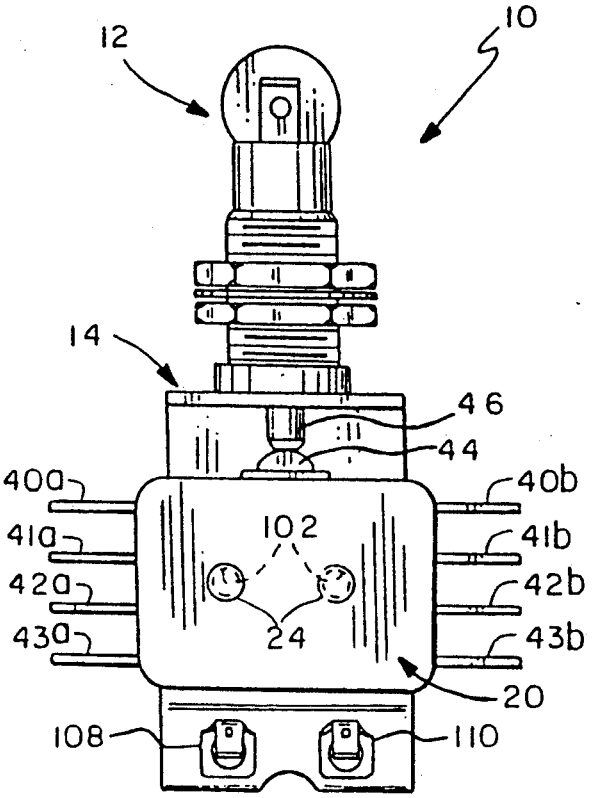
FIG. 1
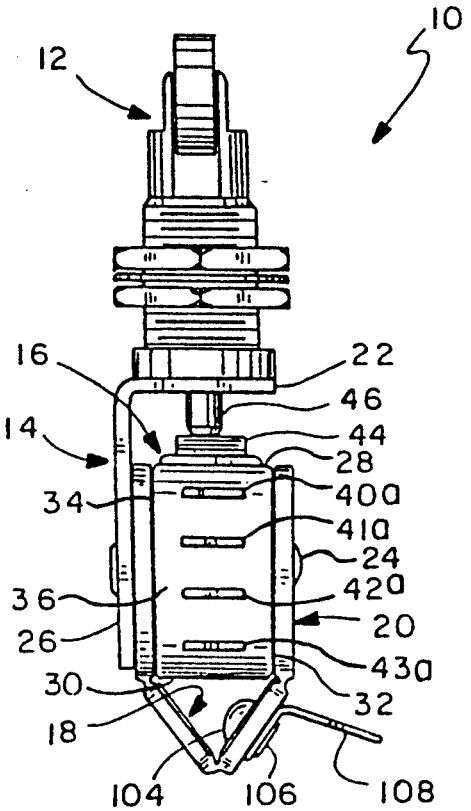
FIG. 2
FIG. 4
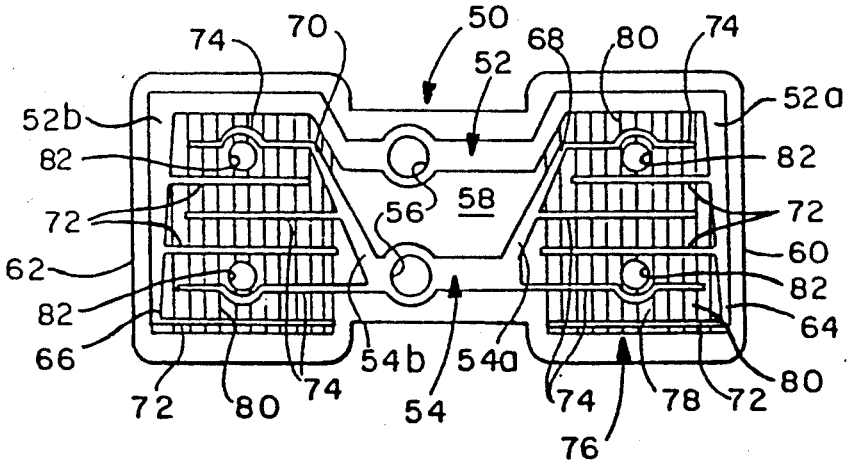
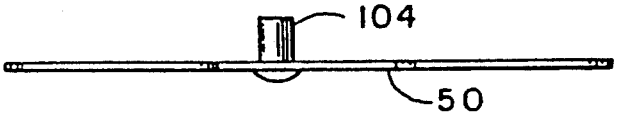
FIG. 5

SELF REGULATING HEATED SWITCH ASSEMBLY

BACKGROUND OF THE INVENTION

1. Field of the Invention

This invention relates generally to electrically heated switch devices and more particularly, it relates to a self regulating heated switch assembly. More specifically, the invention is directed to a self regulating heated switch assembly which utilizes a positive temperature coefficient (PTC) resistive material adapted for heating the interior of a switch housing so as to prevent freezing of switch contacts therein.

2. Description of the Prior Art

It is generally well known in the art that switches which are subjected to low ambient temperatures, such as below freezing, encounter condensation of moisture so as to often cause electrical shorts thereby rendering the switches inoperative. Moreover, when such condensed moisture freezes on the switch contacts at the low temperature environments the switch closing operation providing electrical connection fails to occur. Therefore, it would be desirable to provide a switch assembly which can be maintained at above freezing temperatures, even when utilized in below freezing environments so as to reduce the condensed moisture and thus prevent freezing thereof on the switch contacts.

A prior art search directed to the subject matter of this invention in the U.S. Patent and Trademark Office revealed the following U.S. Letters Patent:

| | | |
|---|---|---|
| 2,632,083 | 4,318,070 | 4,808,960 |
| 3,179,544 | 4,352,008 | 4,823,104 |
| 3,192,345 | 4,399,423 | 4,849,729 |
| 3,402,280 | 4,631,391 | 4,857,711 |
| 3,611,235 | 4,689,595 | 4,862,309 |
| 3,865,626 | 4,703,298 | 4,878,038 |
| 4,174,511 | 4,743,321 | Re 31,367 |

In U.S. Pat. No. 2,632,083 to Stephen R. Shaffer issued on Mar. 17, 1953, there is disclosed a switch housing unit which includes a resistance heating coil mounted between a panel and a bottom wall of the switch housing. A temperature responsive switch (thermostat) is provided for selectively energizing the heating coil so as to electrically heat the switch unit. In U.S. Pat. No. 4,352,008 to Edwin Höfer et al., issued on Sep. 28, 1982, there is disclosed an electric heating device for heating the interior of a switch cabinet so as to prevent condensation therein which includes a PTC electrical resistance heating and temperature regulating device which is situated in the interior of a body made of a thermally conductive material that is thermally connected to a radiator. The radiator is formed by a pair of flat base plates extending laterally from opposite sides of the body and radiator fins extending only from the base plates and only from one flat side thereof.

U.S. Pat. No. 4,631,391 to Günter Piepke issued on Dec. 23, 1986, teaches an electrical heating device for a mirror which includes a pair of electrically conductive heating lining plates to provide heat distribution on the mirror and electrical conductors 9 connected to the plates for supplying a source of power. An insulating layer 3 is provided in two places with spaced openings 13 into which are mounted PTC platelettes 4 that are in electrical contact with the pair of plates. The heating device is adapted to be adhered to the backside of a mirror glass for defogging and demisting the mirror.

U.S. Pat. No. 4,857,711 to Leslie M. Walts issued on Aug. 15, 1989, and assigned to the same assignee as in the present invention teaches a self regulating heating device for a mirror which includes a substrate 14 having an electrical buss system deposited on one surface and being formed of a plurality of interdigitated electrodes 32, 34, 36, 38 and two buss bars 16, 18. Stripes of positive temperature coefficient (PTC) resistive material are printed perpendicularly over the buss system to form a plurality of heating areas and exposed substrate areas. The self regulating heating device is adapted for use in heating automotive-type outside rearview mirrors.

Numerous other switch devices utilizing PTC elements were uncovered in the prior art search in which the PTC element was typically employed to serve as a circuit protection or cut-off device such as by heating a bi-metal contact, as evidenced by U.S. Pat. Nos. 4,823,104; 4,849,729; 4,878,038 and Re. 31,367. The remaining patents listed, but not specifically discussed, are deemed to be of only general interest and are cited to show the state of the art in positive temperature coefficient (PTC) materials and heated switch devices.

However, none of the prior art uncovered in the search disclosed a self regulating heated switch assembly like that of the present invention which includes a switch housing, an insulative cover member, and a PTC heater device sandwiched between the switch housing and the cover member so as to transmit heat into the interior of the switch housing. The switch assembly can be maintained at above freezing temperatures, even when utilized in below freezing environments, so as to reduce the condensed moisture and thus prevent freezing thereof on switch contacts that are in the switch housing.

OBJECTS OF THE INVENTION

Accordingly, it is a general object of the present invention to provide an improved self regulating heated switch assembly which is relatively simple and economical to manufacture and assemble.

It is an object of the present invention to provide a self regulating heated switch assembly which utilizes a positive temperature coefficient (PTC) resistive material adapted for heating the interior of a switch housing so as to prevent freezing of switch contacts therein.

It is another object of the present invention to provide a self regulating heated switch assembly which is formed of a switch housing, an insulative cover member, and a PTC heater device sandwiched between the switch housing and the cover member so as to transmit heat into the interior of the switch housing.

SUMMARY OF THE INVENTION

In accordance with these aims and objectives of the present invention, there is provided a self regulating heated switch assembly which includes a switch housing, an insulative cover member, and a PTC heater device. The switch housing includes a top, bottom, front, rear, and end walls. The insulative cover member is formed of opposed front and rear panels. The front and rear panels are disposed in a spaced apart relationship to the corresponding front and rear walls of the switch housing. The PTC heater device is sandwiched between the front wall of the switch housing and the front panel of the cover member and between the rear wall of the switch housing and the rear panel of the cover member so as to transmit heat into the interior of the switch housing.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein:

FIG. 1 is a front elevational view of a self regulating heated switch assembly, constructed in accordance with the principles of the present invention;

FIG. 2 is a left side elevational view of the switch assembly of FIG. 1;

FIG. 4 is a bottom plan view of the PTC heating device;

FIG. 5 is a left side elevational view of the PTC heating device of FIG. 4.

DESCRIPTION OF THE PREFERRED EMBODIMENT

Figure 3:
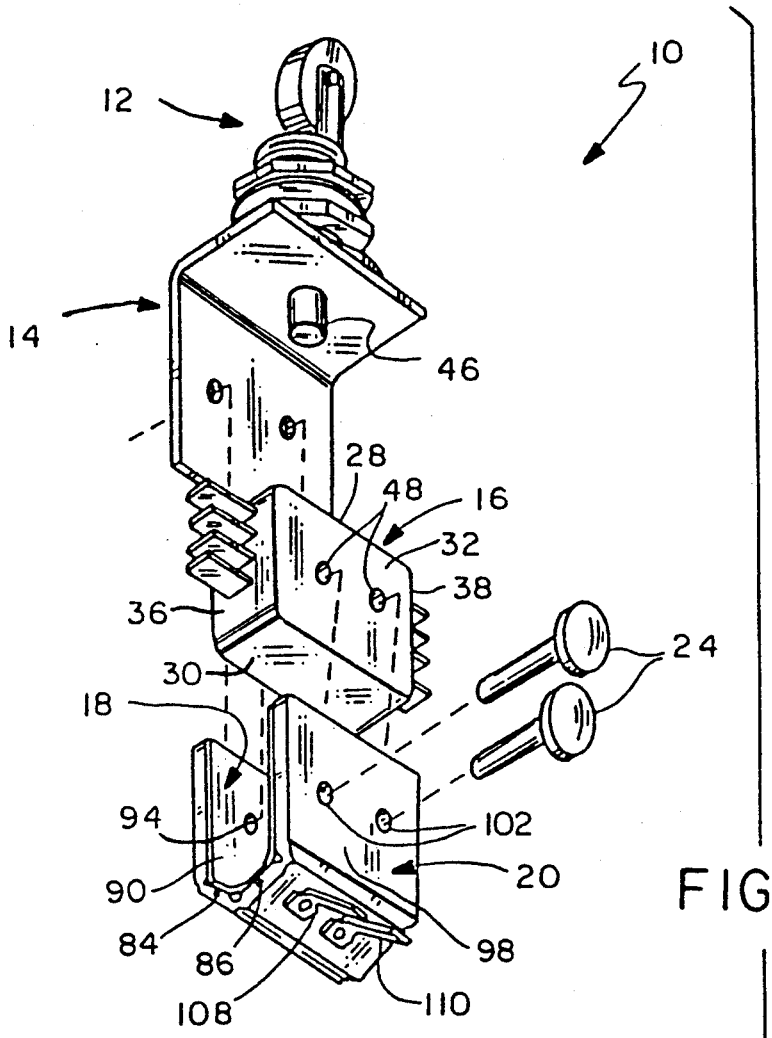
FIG. 3 is an exploded view of the switch assembly of FIG. 1.

Referring now in detail to the drawings, there is shown a self regulating heating switch assembly designated generally by reference numeral 10 which is constructed in accordance with the principles of the present invention. The switch assembly 10 comprises a roller actuator assembly 12, a mounting bracket 14, a switch housing 16, a positive temperature coefficient (PTC) heating device 18, and an insulative cover member 20. The embodiment disclosed herein is specifically adapted for use in low temperature environments wherein condensation of moisture is likely to occur which may cause freezing thereof on switch contacts in the interior of the switch housing. Due to the positive temperature coefficient characteristic of the resistive material whose resistance increases with temperature, the heating device is self regulating so as to provide increased or decreased heating dependent upon the ambient temperature. In other words, at higher ambient temperatures less heating is required; however, at low ambient temperatures, such as below freezing, increased heating will be provided so as to still maintain the interior of the switch housing above freezing, thereby reducing the condensed moisture and preventing freezing thereof on the switch contacts.

As can be seen from FIGS. 1-3, the roller actuator assembly 12 is adapted to be mounted on the shorter leg 22 of the L-shaped mounting bracket 14. The switch housing 16 is secured by fastening means, such as rivets 24, to the longer leg 26 of the L-shaped mounting bracket 14. The switch housing 16 is substantially rectangular in shape and includes a top wall 28, a bottom wall 30, front and rear walls 32 and 34, and end walls 36, 38. The switch housing has four pairs of external switch terminals 40*a*, 40*b*; 41*a*, 41*b*; 42*a*, 42*b*; and 43*a*, 43*b*. All of the switch terminals 40*a*, 40*b* through 43*a*, 43*b* are connected to switch contacts (not shown) located in the interior of the housing 16. The switch terminal pairs 40*a*, 40*b* and 42*a*, 42*b* are normally-opened terminal sets, and the switch terminal pairs 41*a*, 41*b* and 43*a*, 43*b* are normally-closed terminal sets.

The top wall 28 of the switch housing is formed with a push-button 44 which is in contact engagement with a plunger 46 disposed on the bottom of the roller assembly 12. The plunger is adapted to depress the push-button so as to cause each normally-opened terminal sets 40*a*, 40*b* and 42*a*, 42*b* to close and then open for alternately making and breaking electrical connections and to cause each normally-closed terminal sets 41*a*, 41*b* and 43*a*, 43*b* to open and then close for alternately breaking and making the electrical connections. The switch housing includes openings 48 extending from the front wall 32 to the rear wall 34 for receiving therethrough the respective rivets 24. The housing may be formed of any suitable thermoset material such as phenolic and the like. The switch housing is preferably of the type which is commercially available from Illinois Tool Works, Inc. manufactured and sold under their Part No. T-22.

In order to electrically heat the switch housing 16 when it is used in below freezing environments so as to prevent freezing of the condensed moisture on the switch contacts therein, there is provided the positive temperature coefficient (PTC) heating device 18 which can be best seen from FIGS. 4 and 5. The heating device comprises an electrically insulating substrate or casing 50 of, for example, MYLAR of approximately 0.007 inch thickness. The substrate is substantially rectangular in shape. There is deposited on one surface of the casing 50 an electrical buss system. The buss system consists preferably of a layer of printable, electrically conductive material, such as silver polymer material. The conductive buss system is generally deposited on the substrate in a thickness within the range of approximately 8 to 10 microns.

The buss system further includes two buss bars 52, 54 each electrically connected to and extending from opposite sides of respective openings 56 formed in the central portion 58 of the heating device. The buss bar 52 extends along substantially opposite end portions 60, 62 of the peripheral edge of the substrate terminating in free ends 64, 66. The buss bar 54 also extends to the respective opposite end portions 60 and 62 and terminates in free ends 68, 70. Each of the buss bars 52, 54 is also tapered in decreasing area from its corresponding openings 56 towards its respective free ends 64, 66 and 68, 70 so as to achieve the desired power density distribution along their length. The first plurality of conductive paths 72 extend perpendicularly from sections 52*a*, 52*b* of the buss bar 52. Similarly, a second plurality of conductive paths 74 extend perpendicularly from sections 54*a*, 54*b* of the buss bar 54. The first and second conductive paths 72 and 74 define a plurality of spaced apart parallel interdigitated electrodes. In other words, adjacent electrodes connect to opposite ones of the buss bars 52, 54 and extend in opposite parallel directions terminating at a distance spaced apart from the other buss bar.

Screen printed over the buss system is a layer of positive temperature coefficient electrically resistive material 76. The PTC material is preferably a screen printable PTC electrically conductive ink which is screen printed over the buss system and substrate in parallel spaced apart stripes 78 perpendicular to the electrode pattern. The PTC ink is deposited over the buss system in a thickness within the range of approximately 2.5 to 5 microns so as to form a plurality of individual heating areas 80 on the substrate. It will be noted that the end portions 60, 62 of the heating device include mounting apertures 82 which are aligned with the openings 48 formed in the front and rear walls of the switch housing.

Figure 6:
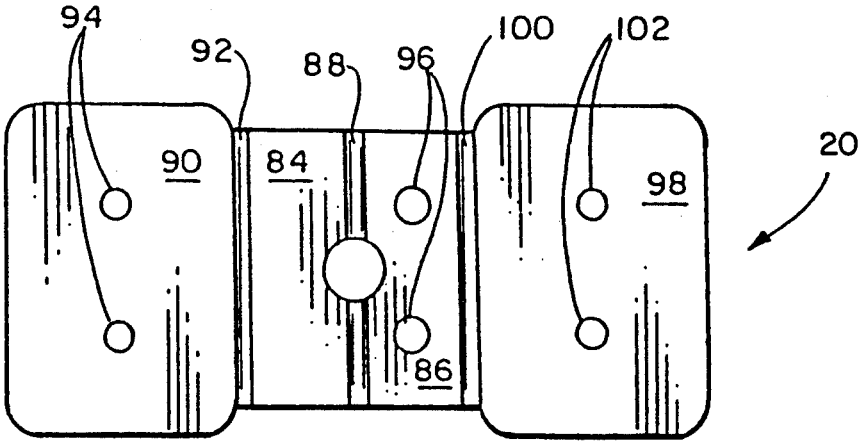
FIG. 6 is a top plan view of the insulative cover member.

In order to insure that the heat generated by the heating device 18 is passed into the interior of the switch housing 16 instead of being allowed to escape to the outside environment, the end portions 60, 62 of the heating device are sandwiched between the respective front and rear walls 32, 34 of the switch housing and the front and rear panels of the insulative cover member 20. As can be seen from FIG. 6, the insulative cover member 20 is also substantially rectangular in shape and has a contour which is similar to but slightly larger than the heating device 18. The cover member may be preferably formed of any suitable thermoplastic material such as Valox so as to function as an insulator for retaining the heat being generated to pass into the interior of the switch housing.

In particular, the cover member includes a first central panel 84 and a second central panel 86 joined to the first central panel by a first narrow-width connecting panel 88 on its one side. The panel 88 is formed of a reduced thickness so as to allow inward folding of the first and second central panels. The other side of the first central panel is joined to a rear panel 90 by a second narrow-width connecting panel 92. The panel 92 is also formed of a reduced thickness so as to permit upward folding of the rear panel relative to the first central panel. The rear panel is provided with mounting openings 94 which are in alignment with the openings 82 of the heating device and the openings 48 in the switch housing. The second central panel 86 is provided with mounting openings 96 which are aligned with the openings 56 of the heating device. The second central panel is also connected to a front panel 98 by a third narrow-width connecting panel 100. The panel 100 has a reduced thickness so as to allow the upward folding of the front panel 98 relative to the second central panel 86. The front panel is provided with mounting openings 102 which are aligned also with the openings 82 in the heating device and the openings 48 in the switch housing.

In assembly, the heating device 18 (FIG. 4) is initially turned over and placed in contact engagement with the insulative cover member 20 (FIG. 6) so that the openings 56 are aligned with the openings 96 in the second connecting panel 86. Further, the openings 82 in the end portions 60, 62 of the heating device will be aligned with the corresponding mounting openings 94, 102 in the rear and front panels 90, 98. Then, rivets 104 (one of which is shown in FIG. 5) are inserted through the openings 56 and 96 and into respective eyelets 106 of heater terminals 108, 110 (FIGS. 2 and 3) so as to electrically connect them to the corresponding buss bars 52, 54. The heater terminals 108 and 110 are adapted to be connected to an external power supply source.

Next, the insulative cover member 20 and the heater device 18 are folded upwardly so as to form a U-shaped configuration and receives therein the exterior surfaces of the front and rear walls 32, 34 of the switch housing so that the mounting openings 94, 102 (also openings 82) are aligned with the openings 48. Finally, the rivets 24 are inserted through the corresponding mounting openings 102 in the front panel 98, extends through the openings 48 of the switch housing, and then out from the mounting openings 94 of the rear panel 90 and into the leg 26 of the mounting bracket 14 so as to permanently secure the front and rear panels of the cover member in a space apart relationship to the respective front and rear walls of the switch housing, the end portions of the heater device being sandwiched therebetween.

In operation, when a voltage is applied to the heater terminals 108, 110 and thus across the electrode array current will flow through the PTC material between the electrodes causing the individual heating areas 80 to heat dependent upon the ambient temperature and the electrical characteristics of the PTC material. As is well known, the current flow and heating effect of the PTC material depends on its temperature which will change as the ambient temperature changes and at a predetermined temperature of the PTC material the resistivity of the material increases causing the material to conduct a smaller amount of current so that the heating areas generate relatively less heat. A self regulating heated switch assembly of the present invention was constructed and tested and found to maintain the interior of the switch housing above freezing at ambient temperature below −15° C.

From the foregoing detailed description, it can thus be seen that the present invention provides a self regulating heated switch assembly which utilizes a positive temperature coefficient resistive material adapted for heating the interior of a switch housing so as to prevent freezing of the switch contacts therein. The heated switch assembly includes a switch housing, insulative cover member, and a PTC heater device sandwiched between the switch housing and the cover member so as to transmit heat into the interior of the switch housing.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A self-regulating heated switch assembly, comprising:

a switch housing having top, bottom, front, rear, and end walls;

an insulative cover member comprising opposed front and rear panels, said front and rear panels being disposed in a spaced apart relationship with respect to said corresponding front and rear walls of said switch housing; and a PTC heater device comprising a first heating section sandwiched between said front wall of said switch housing and said front panel of said cover member, and a second heating section of said PTC heater device sandwiched between said rear wall of said switch housing and said rear panel of said cover member so as to transmit heat into the interior of said switch housing.

2. A switch assembly as claimed in claim 1, wherein said switch housing has a substantially rectangular parallelepiped configuration and is formed of a thermoplastic material.

3. A switch assembly as claimed in claim 1, wherein said PTC heater device is comprised of an electrically insulative substrate; an electrical buss system disposed on one surface of said substrate and including a pair of buss bars and two electrode patterns having a plurality of spaced apart parallel interdigitated electrodes, adjacent electrodes of said plurality of interdigitated electrodes being connected to different ones of said pair of buss bars; and an electrically resistive layer of material having a positive temperature coefficient and being deposited over said electrical buss system in a plurality of parallel spaced apart strips oriented perpendicularly to said interdigitated electrodes defining a plurality of heater areas between adjacent electrodes.

4. A switch assembly as claimed in claim 3, further comprising terminal means connected to said buss bars for supplying a source of power to said heater device.

5. A switch assembly as claimed in claim 1, further comprising means for permanently mounting said insulative cover member, said heater device and said switch housing together.

6. A self-regulating heated switch assembly, comprising:

switch housing means having a plurality of sides with at least two sides thereof being opposed;

a PTC heater device having sections thereof disposed upon the exterior of said two opposed sides of said switch housing means and in heat-transmitting relationship therewith for transmitting heat into the interior of said switch housing means; and insulative cover means covering said PTC heater device sections for retaining the heat generated by said PTC heater device and passing to the interior of said switch housing means and thereby preventing the same from escaping to the outside environment.

7. A switch assembly as claimed in claim 6, wherein said switch housing means has a substantially rectangular parallelepiped configuration and is formed of a thermoset material.

8. A switch assembly as claimed in claim 6, wherein said PTC heater device is comprised of an electrically insulative substrate; an electrical buss system disposed on one surface of said substrate and including a pair of buss bars and two electrode patterns having a plurality of spaced apart parallel interdigitated electrodes, adjacent electrodes of said plurality of interdigitated electrodes being connected to different ones of said pair of buss bars; and an electrically resistive layer of material having a positive temperature coefficient and being deposited over said electrical buss system in a plurality of parallel spaced apart strips oriented perpendicularly to said interdigitated electrodes defining a plurality of heater areas between adjacent electrodes.

9. A switch assembly as claimed in claim 8, further comprising terminal means connected to said buss bars for supplying a source of power to said heater means.

10. A switch assembly as claimed in claim 6, further comprising means for permanently mounting said insulative cover means, said heater device and said switch housing means together.

11. A switch assembly as set forth in claim 3, wherein:

said PTC heater device has a substantially rectangular configuration with said pair of buss bars disposed within a central portion of said PTC heater device and said two electrode patterns being disposed within opposite end portions of said PTC heater device upon opposite sides of said central portion of said PTC heater device.

12. A switch assembly as set forth in claim 11, wherein:

said insulative cover member has a substantially rectangular configuration as seen in plan view with opposite end sections thereof, defining said front and rear panels, covering said first and second heating sections of said PTC heater device upon which said two electrode patterns of said PTC heater device are disposed.

13. A switch assembly as set forth in claim 12, further comprising:

means defining fold sections upon said insulative cover member such that said opposite end sections thereof are foldable with respect to a central section thereof whereby said insulative cover member has a substantially U-shaped configuration as seen in end elevation.

14. A switch assembly as set forth in claim 8, wherein:

said PTC heater device has a substantially rectangular configuration with said pair of buss bars disposed within a central portion of said PTC heater device and said two electrode patterns being disposed within opposite end portions of said PTC heater device upon opposite sides of said central portion of said PTC heater device.

15. A switch assembly as set forth in claim 14, wherein:

said insulative cover member has a substantially rectangular configuration as seen in plan view with opposite end sections thereof, defining said front and rear panels, covering said first and second heating sections of said PTC heater device upon which said two electrode patterns of said PTC heater device are disposed.

16. A switch assembly as set forth in claim 15, wherein:

means defining fold sections upon said insulative cover member such that said opposite end sections thereof are foldable with respect to a central section thereof whereby said insulative cover member has a substantially U-shaped configuration as seen in end elevation.

* * * * *